US006300606B1

(12) United States Patent
Engelmann et al.

(10) Patent No.: US 6,300,606 B1
(45) Date of Patent: Oct. 9, 2001

(54) METHOD AND DEVICE FOR DETECTION OF A BOIL DRY CONDITION OF A UTENSIL PLACED ON A GLASS-CERAMIC COOKING SURFACE OF A COOKING UNIT

(75) Inventors: Harry Engelmann, Ingelheim; Kurt Schaupert, Hofheim, both of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/497,582

(22) Filed: Feb. 3, 2000

(30) Foreign Application Priority Data

Feb. 13, 1999 (DE) ..... 199 06 115

(51) Int. Cl.[7] ..... H05B 1/02
(52) U.S. Cl. ..... 219/492; 219/492
(58) Field of Search ..... 219/482, 483, 219/490, 492, 494, 497, 448.12, 448.14, 464.1, 445.1, 446.1, 441

(56) References Cited

U.S. PATENT DOCUMENTS 4,493,981 1/1985 Payne ..... 219/492

FOREIGN PATENT DOCUMENTS 40 22 846 C2 8/1994 (DE) .
43 36 752 A1 5/1995 (DE) .
196 32 057 A1 2/1998 (DE) .

*Primary Examiner*—Tu Ba Hoang
(74) *Attorney, Agent, or Firm*—Michael J. Striker

(57) ABSTRACT

The method for detecting a boil dry condition of a cooking utensil or vessel placed on a glass-ceramic cooking surface of a cooking unit having at least one cooking zone includes determination of definite criteria for occurrence of the boil dry condition based on the first and second derivatives of the cooking zone temperature, on detection of operation of the heating element power control device and the power input to the heating element in accordance with a three stage comparison of the cooking zone temperature and the shutoff temperature. When the measured cooking zone temperature is well below the shutoff temperature and after a predetermined time interval from last operation of the heating element control device by an operator, the occurrence of positive first and second derivatives signals the boil dry condition. The device for detecting a boil dry condition of a cooking utensil or vessel placed on a glass-ceramic cooking surface of a cooking unit having at least one cooking zone includes a cooking zone temperature sensor; signal generating devices for detecting operation of the heating element power control device, for energy input to the heating element and for the shutoff temperature and a control and analysis device for receiving these input signals and for generating a control signal indicative of the boil dry condition according to the above-described method using the input signals.

19 Claims, 6 Drawing Sheets

METHOD AND DEVICE FOR DETECTION OF A BOIL DRY CONDITION OF A UTENSIL PLACED ON A GLASS-CERAMIC COOKING SURFACE OF A COOKING UNIT

BACKGROUND OF THE INVENTION

1. Field of the Invention

The present invention relates to a method of detection of a boil dry condition of a utensil placed on a glass-ceramic cooking surface of a cooking unit, which has at least one cooking area, which is associated with a heating element, whose energy input is adjusted by means of a heating element power control device, and in which the temperature, or a variable dependent on it, such as a signal (temperature signal), is measured in operation and is limited by means of a temperature limiting protective device with an adjustable cutoff temperature.

The invention also relates to a device or apparatus for performing this method.

2. Prior Art

The moisture or liquid present in cooking material in a cooking utensil or vessel can be completely evaporated during cooking when too much heat energy is supplied or when it is heated for too long a time interval. This situation is called a boil dry condition. It can lead to damage of the cooking apparatus in the case of aqueous cooking materials, especially of the glass-ceramic cooking surface and the vessel. With other cooking materials there is a danger that the cooking material can ignite or burn and damage surrounding devices. In this case the energy supply is preferably turned off and the operator is at least warned. Typically this error occurs when high heat energy input used for a rapid cooking phase is not turned off because the operator has forgotten that high heat energy input is being used.

Of course the surface temperature of the cooking area on glass-ceramic cooking surfaces of cooking units is typically monitored and protected by means of rod-like mechanical temperature limiting protective devices. These devices measure the average temperature under the cooking area and limit it. The shutoff temperature, also its so-called threshold value, is established on the basis of the properties of the standard cooking vessels or utensils and the glass-ceramic material. Also an electronic device for limiting the temperature is known. However only the behavior of the mechanical temperature limiting protective devices is sufficient sensitive, so that an additional evaluation of temperature information is not required.

The boil dry condition of a cooking utensil cannot be detected only by means of the typical temperature limiting protective device provided with a glass-ceramic cooking surface of a cooking unit.

A method and corresponding device for detection of the so-called boil dry condition is disclosed in U.S. Pat. No. 4,493,981. In this method the first derivative of the temperature with respect to time is used as the indicator for this condition. When it exceeds a certain predetermined limiting value, then a boil dry condition is detected. The limiting value is dependent among other things on the type of cooking unit and the actual power set. Furthermore a boiled dry vessel or utensil is detected, when the temperature in the cooking vessel or utensil exceeds a certain limiting value. Also this value depends on the type of cooking unit and the actual input power. When a boil dry condition is detected, the operator is warned or the cooking unit is turned off.

In this known method it is disadvantageous that the detection of the critical operating condition depends on the actual input power. Also in practice this has the consequence that no uniform limit for the first time derivative of the temperature can be used to reliably detect the boil dry condition for different types of cooking utensils. More rapid increases in temperature can occur in filled poorly heat-conducting utensils than in empty, heat conductive utensils.

The boil dry condition is detected by measurement of the temperature in the interior and exterior of a two-circuit heating element in the device described in DE 40 22 846 C2. This known device is however limited to glass-ceramic cooking surfaces with two-circuit heating elements.

A method for detection of the boil dry condition of a vessel on a glass-ceramic cooking surface of a cooking unit and an associated apparatus are disclosed in DE 43 36 752 A1. In this method the temperature is measured and its first derivative is determined. When the value of the first derivative first exceeds a predetermined boundary or limiting value, the initial heating power is reduced by 100%. This reference also discloses that empty metal vessels being heated are detected because of the reduced electrical heating power required to reach the same temperature and the current supply is shut off when the input power drops below a certain predetermined value. This method has the same disadvantage as described above for the U.S. Patent reference.

SUMMARY OF THE INVENTION

It is an object of the present invention to provide a method and apparatus of the above-described kind for detecting a boil dry condition, wherein a reliable detection of this critical operating condition of a cooking vessel or utensil is possible independently of the actual input power and also independently of the type of cooking vessel or utensil, so that reliable protection of the associated cooking area is possible during this critical operating state.

According to the following different embodiments of the invention, which differ according to the relative magnitude of the actual temperature in comparison to the shutoff temperature, with a first temperature pattern or relationship the method comprises the following steps:

a) comparing a measured temperature with a shutoff temperature;

b) forming both the first and also the second time derivative of a temperature signal and detecting operation of a heating element power control device, when the measured temperature is outside of a predetermined temperature range at the shutoff temperature as determined by the comparing; and c) generating a control signal, when both time derivatives are positive and the heating element power control device has not been operated within a predetermined time interval to increase the input power; or with a second temperature pattern or relationship a) comparing the measured temperature with a shutoff temperature;

b) determining the energy input to the heating element and detecting operation of the heating element power control device when the measured temperature corresponds to the shutoff temperature according to the comparing; and c) generating a control signal when the energy input is reduced a predetermined amount and the heating element power control device has not been operated within a predetermined time interval to reduce the input power; or with a third temperature pattern or relationship a) comparing the measured temperature with a shutoff temperature;

b) lowering the shutoff temperature to the measured temperature, if a temperature equilibrium exists within a predetermined temperature range at the shutoff temperature during the comparing;

c) determining the energy input to the heating element and detecting operation of the heating element power control device; and d) generating a control signal when the energy input is reduced a predetermined amount and the heating element power control device has not been operated to reduce the input power within a predetermined time interval.

The foregoing features of the method according to the invention very advantageously provide a reliable detection of a boil dry condition of a cooking utensil or vessel independently of the actual power input and also independently of the cooking utensil type. The disclosed sequence of process steps produces no transient or spurious results, but describes the conditions for detection of the boil dry condition. This criteria can temporarily supercede the operation of the heating element power control device prior to testing of the temperature threshold.

The individual temperature patterns or relationships are coupled with each other, since the temperature of the cooking region is not constant, chiefly the heating element power control device can be operated at any time.

In the case of the second temperature pattern the detection of the critical operating state according to a preferred embodiment of the invention is such that, when the heating element power control device is operated to reduce the input power, the generation of the control signal is halted for a predetermined time interval, preferably for about two minutes. After that whether or not the temperature is still at the shutoff temperature or has dropped further is tested, so that the method reverts to the case in which both derivatives being positive signals the critical operating condition, i.e. a temperature pattern with the corresponding signal formation conditions according to the first temperature pattern.

When the heating element power control device is operated in the case of the third temperature pattern, according to one embodiment of the invention then the shutoff temperature is again set to its original value, so that, if necessary, the full power is ready for higher temperatures.

Experience has shown that a boil dry condition can usually occur several minutes after the operator leaves the cooking range. According to a further embodiment of the invention the method is conducted so that the predetermined time interval for deactivation of formation of a control signal is about two minutes after operation of the heating element power control device.

With unsatisfactory conditions, e.g. little liquid in the cooking utensil or vessel and a high energy input, the boil dry condition can certainly be detected.

Experiments have shown that one can conduct the method reliably with the first and third temperature patterns, when according to one embodiment of the invention the predetermined temperature range at the shutoff temperature is about 40K.

Further experiments have shown that the critical operating state can be reliably detected with the second and third temperature pattern, when the predetermined minimum amount for reduction of the energy input is in the range of about 2% per minute according to another preferred embodiment of the invention.

When the energy input to the heating element of the heating zone is pulsed or clocked, then it has proven to be suitable for accurate detection of the temperature when the temperature signal is similarly clocked or pulsed and is synchronized to the pulsed or clocked input.

In order to detect the critical operating state without delay, especially, when the energy input is pulsed or clocked, for example with a rate of a pulse per 40 seconds, according to a further preferred embodiment the method the first time derivative of the temperature signal and a second time derivative are immediately formed in the following manner. The first time derivative is formed from an adjusting rate determined from previous temperature measured values and the difference between its extrapolated value at a current time and the actual measured temperature value at that time. The second time derivative is formed from an adjusting rate for the first time derivative determined from earlier values of the first time derivative and the difference between its extrapolated value at a current time and the actual value of the first time derivative at that time.

The interpretation of the determination of the critical operating state can occur in different ways. In the simplest case this state can be signaled, advantageously with an acoustic or optical warning signal, but also by means of a remote acting signal (home bus). During a completely automatic regulation the heating element is preferably directly turned off.

The above-described object is also attained by an apparatus or device for performing the above-described three part method, based on a cooking unit with a glass-ceramic cooking surface, which has at least one cooking area or zone, which is associated with a heating element, whose energy input is adjustable by a heating element power control device, in which a temperature sensor is mounted, which detects the temperature of the cooking area during operation or a variable derived from it as a signal (temperature signal), and which is associated with a temperature limiting protective device with an adjustable shutoff threshold.

According to the invention the device for detecting and optionally signaling the boil dry condition includes an electronic analysis and control unit for processing various input signals and generating control signals. This analysis and control unit has inputs receiving signals corresponding to the shutoff temperature ($T_A$), the energy input ($E_z$) to the heating element, and detecting operation ($B_R$) of the heating element power control device as well as the cooking zone temperature (T). The analysis and control unit also has outputs for control signals for adjustment of the shutoff temperature of the temperature limiting protective device, for the heating element power control device and optionally for a signaling and warning device. The analysis and control includes a first comparison stage or means for comparing the measured cooking zone temperature with the shutoff temperature and an additional stage for generating a control signal signaling detection of the boil dry condition of the cooking vessel or utensil according to the comparing. The additional stage has means for forming the first and also the second time derivatives of the temperature signal and for detection of operation of the heating element power control device, when the measured cooking zone temperature is outside of a predetermined temperature range at the shutoff temperature. The additional stage also has means for forming a control signal when both time derivatives are positive and the heating element power control device has not been operated within a predetermined time interval to increase the input power.

For the case in which the temperature in the cooking zone is equal to the shutoff temperature, the additional stage has means for measuring the energy input to the heating element and for detecting operation of the heating element power control device from the input signals and means for forming a control signal when the energy input is reduced and the heating element power control device has not been operated within a predetermined time interval to reduce the input power.

Furthermore for the case in which there is a temperature equilibrium within a predetermined interval of the shutoff temperature the additional stage has means for lowering the shutoff temperature to the value of the measured cooking zone temperature, and for determination of the energy input to the heating element and for detecting operation of the heating element power control device from the input signals and means for generating a control signal when the energy input is reduced about a predetermined amount and the heating element power control device has not been operated within a predetermined time interval to reduce the input power.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE PREFERRED EMBODIMENT

The method according to the invention for detecting a boil dry condition of a cooking utensil is based on evaluation of the change of heat flow and the temperature variables connected with it, the temperature and the turn-on time of the cooking unit, as well as the variables derived from them.

Three operational principals are to be distinguished depending on the shutoff temperature of typically 560° C. of the basic temperature limiting protective device present in glass-ceramic cooking ranges or units.

1. Temperature of the Cooking Range below the Shutoff Temperature

Figure 1:
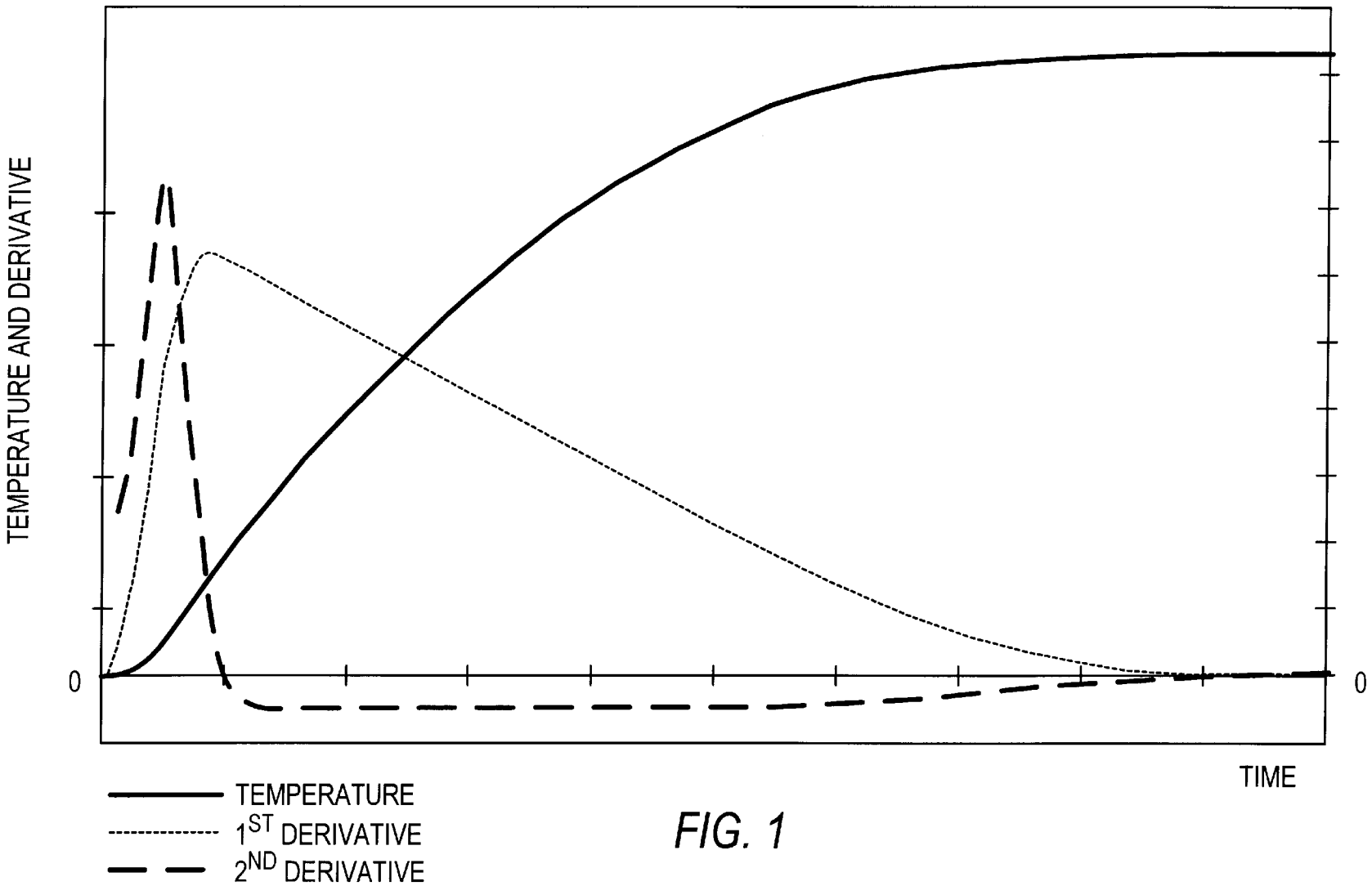
FIG. 1 is a graphical illustration of the dependence of temperature during a cooking process on time, including the course of the first and second time derivative of the temperature.

The time course of the temperature in this region and the first and second time derivatives of that variable are illustrated in the curves shown in FIG. 1. After turning the cooking unit on, i.e. during the cooking process, the temperature of the cooking surface increases, approaching a saturation value, which is characterized by an equilibrium between energy input and energy outflow due to losses and evaporation of the watery cooking materials (solid curve). The temporal change ($1^{St}$ derivative) of the temperature increases according to the dotted curve first rapidly to a maximum value, and then slowly drops. The initial phase of the first time derivative of the temperature arises because of heating of the heating element associated with the cooking area. After that the first time derivative falls, since the increase of the temperature is less steep or flatter because of increasing losses at higher temperature. The second time derivative (dashed curve) is positive in the initial phase, but after that is negative during further heating.

Figure 2:
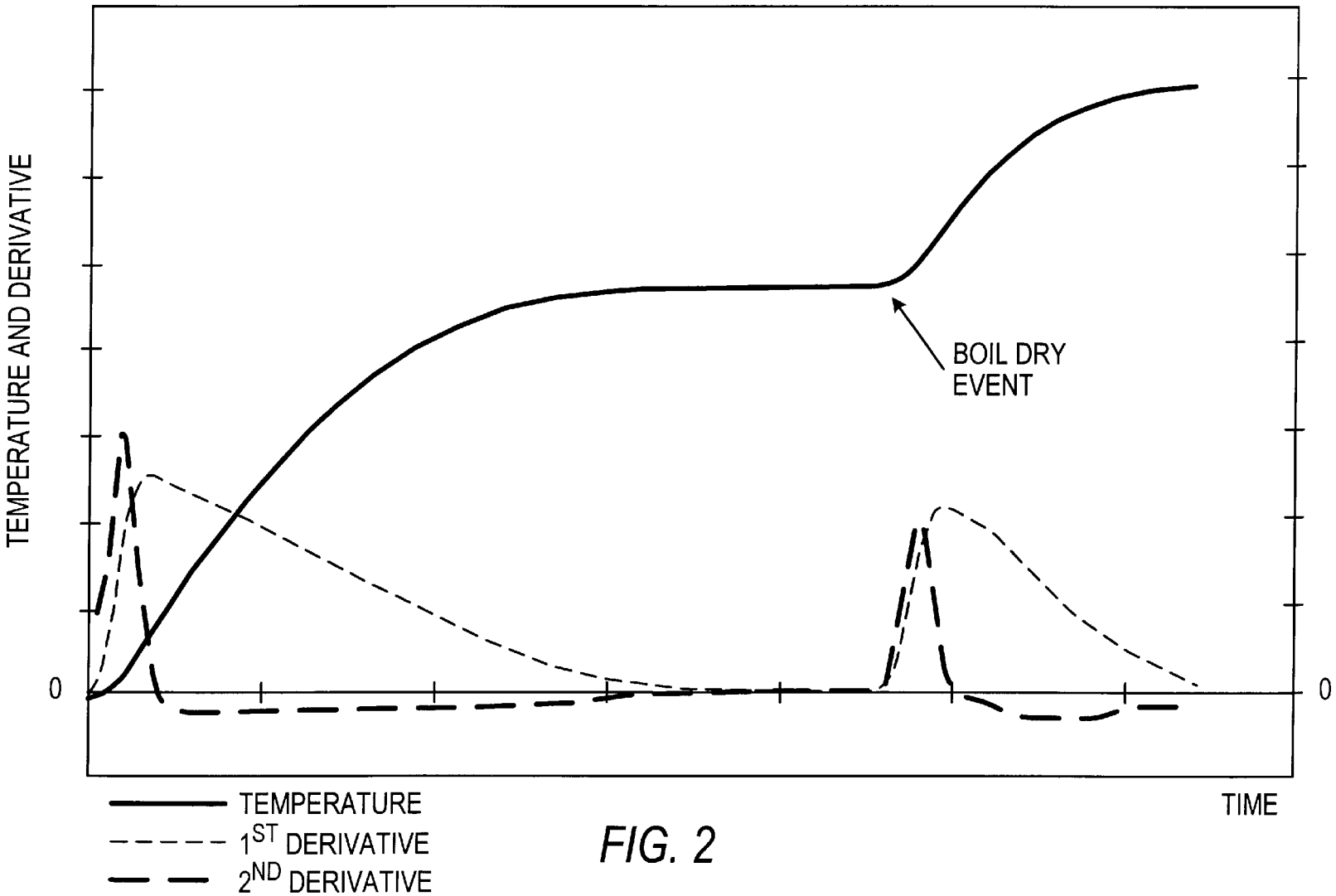
FIG. 2 is a graphical illustration similar to FIG. 1, but also showing the behavior of the temperature and derivatives when the cooking utensil is in a boil dry condition.

If a utensil or cooking vessel placed on the cooking surface becomes empty during a cooking process, a fresh or additional temperature increase is connected with that event according to the temperature vs. time curve shown in FIG. 2 analogous to that of FIG. 1. At the point in the curve when the event is detected or characterized both the first and the second time derivatives are positive. Because of that behavior this phase differs from the normal heating behavior according to the initial or starting phase shown in FIG. 1, in which the second time derivative is negative, and may thus be evaluated for detection of the boil dry condition of the cooking vessel or utensil.

The behavior of the temperature and thus the values of the first and second derivative depend however on the input power to the heating element in the cooking zone by means of the usual heating element power control device. This condition must thus be considered during detection of the critical boil dry operating condition.

When the input power is increased by means of the heating element power control device, the second derivative is similarly positive as well as the first derivative, i.e. the same variable pattern is produced as in a boil dry event as in FIG. 2. In this case the operator however is obviously aware that in this case the detection of the critical operating condition can shortly take place again without impairing the protection. Typically about two minutes after operation of the heating element power control device the detection is again active.

Figure 3:
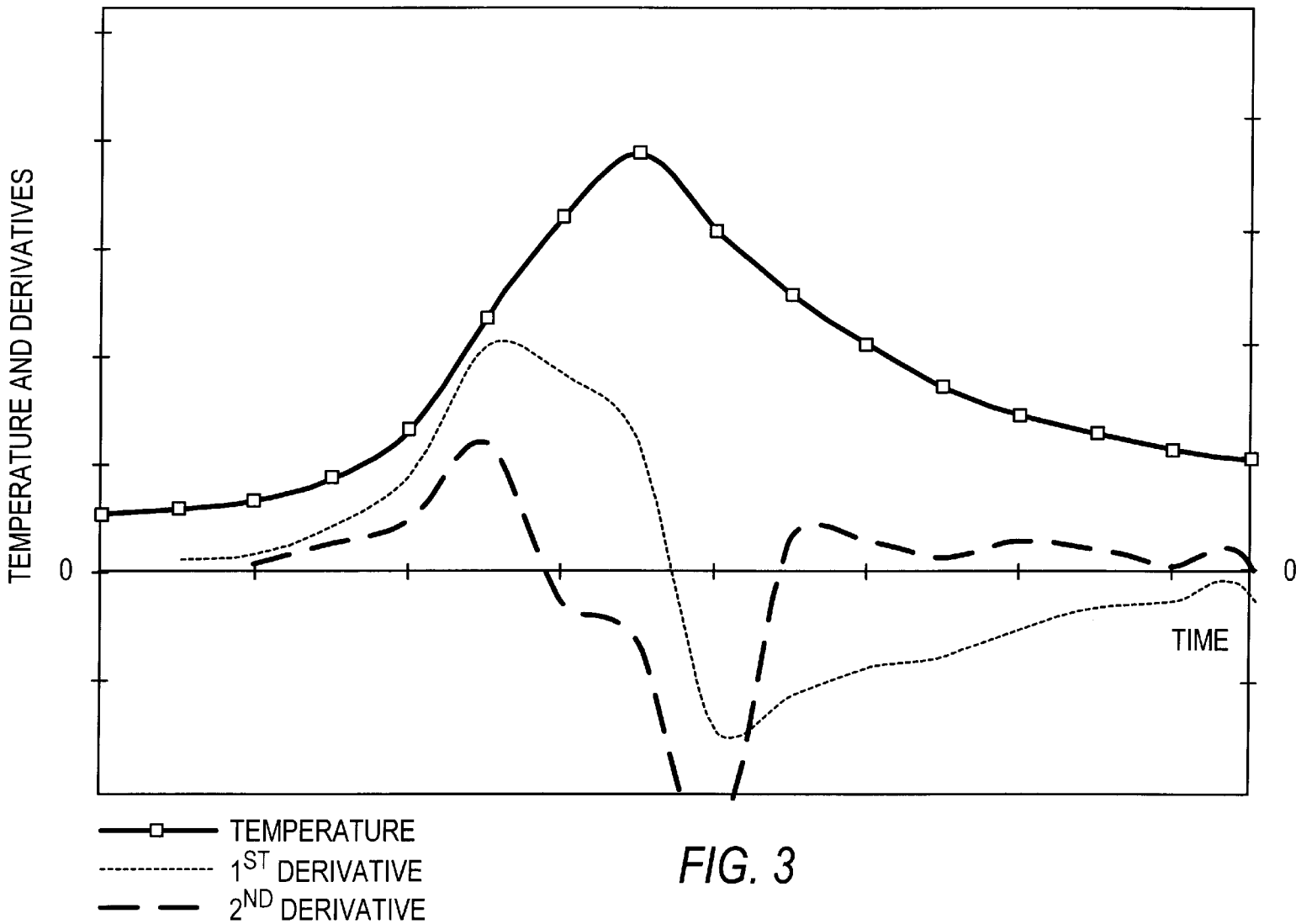
FIG. 3 is a graphical illustration similar to FIG. 1, but with a reduction of input power during the cooking phase.

If the power input by means of the heating element power control device is reduced, the second derivative is positive after a short time, as shown in the graphical illustration according to FIG. 3. However the first derivative is negative in this case, so that this case can be easily distinguished by the detection device from the critical operating state.

The effectiveness of the detection of the critical operating condition of the empty cooking vessel or utensil depends to a significant extent on the accuracy of the measurement of temperature and/or the detection of its time dependent behavior. However this is typically influenced by the power control in the cooking range. This dependence is illustrated in connection with the first case. That is also true for the other temperature ranges, which are still to be discussed.

According to the state of the art the power control in the cooking area typically occurs by pulsing or clocking the input current. In a fixed total time interval of e.g. 40 s the ratio of the turn-on time, i.e. time during which current flows, to the total time is varied. This switching on and off leads to a periodic change of the glass-ceramic material temperature, which is superimposed on the long time interval temperature changes. In order to filter out the disturbing influence of these periodic changes, according to one embodiment of the invention the temperature is measured synchronized to the current pulses, e.g. always on the turn-off side or flank of a current pulse.

In another embodiment for exact temperature measurement the power is practically continuously adjusted, e.g. by a pulse packet control, so that the temperature behavior is measured continuously.

The accuracy of the temperature measurement also requires careful consideration. In practice the temperature measurement is subject to variations or fluctuations due to measurement errors and interfering variables. Usually several values are time averaged to reduce these effects. However this causes a delay in the detection of the empty cooking utensil, since the several values must first be averaged. Especially during operating input power controller at a typical rate of a pulse per 40 seconds this delay is intolerable for detection of the critical operating condition.

Figure 4:
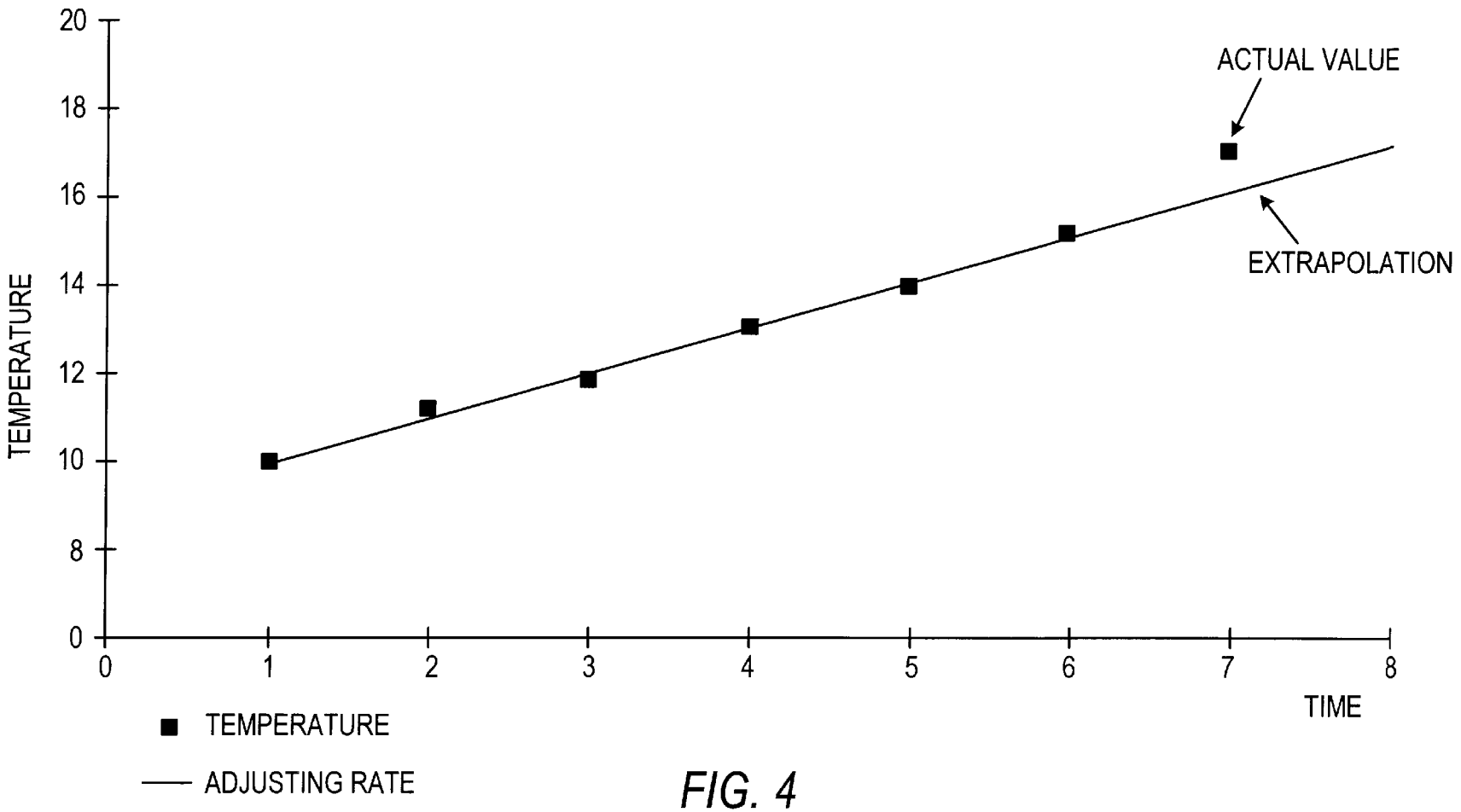
FIG. 4 is a graphical illustration of the dependence of temperature on time, in which past temperature values are averaged by means of an adjusting rate and the actual temperature value is compared with the temporal extrapolation of the adjusting rate.

In a preferred embodiment of the invention thus the previously measured temperature values are weighted by means of an adjusting rate. The actual values however are not averaged, but compared with the temporal extrapolation of the adjusting rate, as shown in FIG. 4. This is performed in an advantageous manner, since the system is at least approximately in equilibrium prior to the boil dry condition, but changes however in a discontinuous manner due to the occurrence of the boil dry condition.

The temperature of the glass-ceramic material need not be directly measured in order to perform the method according to the invention. The method may also be successfully preformed by measurement of a temperature-dependent variable, such as the bulk resistance of sensors arranged on the underside of the cooking surface according to DE 196 32 057 A1. It is advantageous here that the aging of the sensors does not hinder the process, since only the time derivative of the resistance values are used. A temperature calibration of the sensors is not required.

In the case of this first temperature pattern then the operating state of the empty cooking vessel or utensil is thus detected as critical in a first temperature range, when both the first and the second time derivative of the temperature are positive and the heating element power control device was not operated within a predetermined time interval to increase the input power. This pattern or condition is not used however in the case of the subsequently described second temperature pattern.

2. Cooking Zone Temperature at the Shutoff Temperature of the Temperature Limiting Protective Device If the temperature of the glass-ceramic cooking surface is at the shutoff temperature of the temperature limiting protective device, the temperature does not change when the boil dry condition occurs. With this temperature pattern or behavior the temperature limiting protective device controls the heating element to produce a constant temperature. The poorer heat transfer during the boil dry condition manifests itself then in a reduced current turn on time per cycle during periodic energy input. Then the current turn-on time reduction is then used as an indicator of the critical operating condition, although the heating element power control device was not operated.

If the heating element power control device was operated to increase the power the relative turn-on time would not change, since the system power is limited by means of the temperature limiting protective device. If the heating element power control device is operated to reduce the power, however the relative turn on time is similar reduced without the occurrence of the critical operating condition. Thus after adjustment of the heating element input power, is the monitoring is shut off for a short time, typically for 2 minutes, in this case. If the temperature is reduced far below the shut off temperature, the monitoring may be adapted to the criterion based on determination of the two time derivatives of the temperature according to the pattern described above in the first case or embodiment. Also here in operation of the heating element power control device a person is obviously observing and the unit is monitoring so that no boil dry condition can occur in the two-minute deactivation phase.

3. Cooking Zone Temperature just below the Shutoff Temperature

If the temperature of the filled cooking utensil increases so that the temperature is in equilibrium is just under the shutoff temperature, the temperature increases only slightly during a boil dry condition until it is limited by the temperature limiting protective device. The signals from the first and second derivatives are then to small for a reliable evaluation according to the method explained in the above No. 1 section.

In this case the shutoff temperature of the temperature limiting protective device is reduced to the measured temperature and a empty cooking utensil or a boil dry condition of a cooking utensil is detected as explained in the above No. 2 section.

This method presupposes first the detection of a temperature equilibrium state. This state is detected when the temperature changes only insignificantly over a longer time interval. When the temperature then is only slightly below the standard shutoff temperature of the temperature limiting protective device, this shutoff temperature is reduced to the actual temperature value.

Normally a lower shutoff temperature of the temperature limiting device reduces the performance of the cooking unit and leads to a longer cooking duration, since the maximum temperature is reduced. In the present method however this is not the situation, since the temperature is only adjusted when the equilibrium temperature is in the doubtful range besides.

When the heating element power control device is operated again, the lowering of the shutoff temperature of the temperature limiting protective device is halted in order to prepare, if necessary, for applying full power at higher temperature.

In practice a range of 40 K below the normal shutoff temperature has proven sufficient for detection of the critical operating state according to the third case pattern or embodiment.

Figure 5:
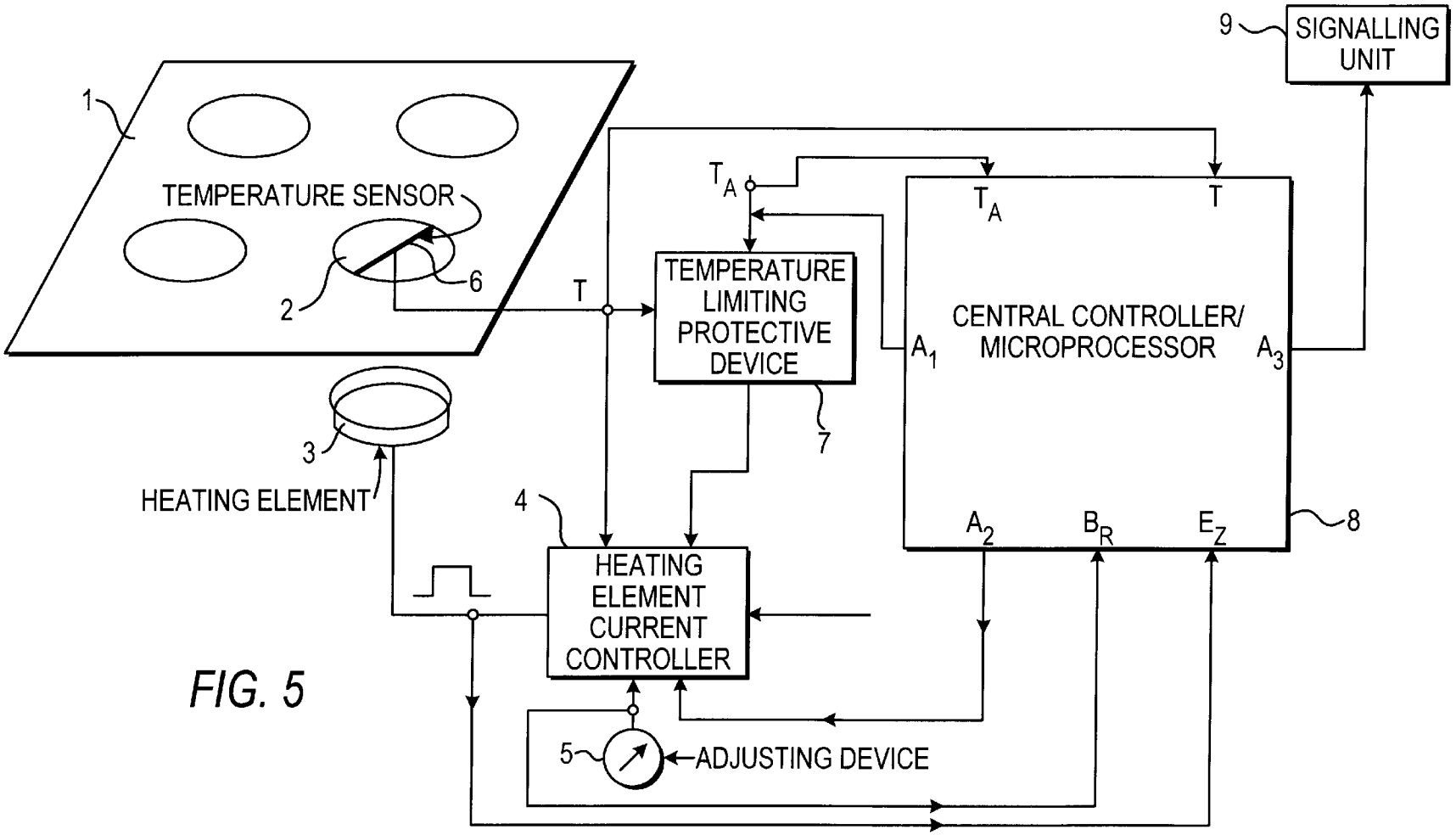
FIG. 5 is a block diagram of an apparatus for performing the method for detecting a boil dry condition of a cooking utensil.

In FIG. 5 one embodiment of an apparatus or device for detection of the boil dry state of the cooking utensil or vessel is shown with a glass-ceramic cooking surface of a cooking unit, which has four cooking areas 2 in the illustrated embodiment. Each cooking area 2 is associated with a heating element 3, for example an electrically operated radiant heating element, whose energy input is adjusted by means of a manual adjusting device 5, for example a contact switch, rotary switch or the like. Each cooking area 2 further is associated with a temperature sensor 6, which directly detects the temperature in the cooking area 2 or a variable or parameter derived from it in operation. These kinds of temperature sensors for cooking areas are available commercially in many different embodiments or described in published references, e.g. in DE 196 32 057 A1. A heating element and temperature sensor is shown only for one cooking area in FIG. 5 to provide an improved illustration.

The corresponding temperature signal T of the temperature sensor 6 is input first to the control stage 4 as an actual value for the usual temperature control of the cooking area. It also is input to a temperature limiting protective device 7 with an adjustable shutoff temperature $T_A$, here embodied electronically, which is connected with the control stage 4. The temperature limiting protective device 7 limits the temperature of the cooking area to a value of the shutoff temperature $T_A$, also designated the threshold value. This sort of the temperature limiting protective device with an adjustable shutoff temperature is similarly known.

The temperature signal is fed to a central controller or analysis and control unit 8, in which the detection of the critical operating state of the cooking utensil, i.e. the boil dry condition, takes place. For this purpose the analysis and control unit 8 is fed additional signals, namely

- the shutoff temperature $T_A$ of the temperature limiting protective device;
- the signal $E_2$, which is a measure of the energy input to the heating element 3,
- signal $B_R$, which is a measure of the operation of the adjusting element 5, including the direction, in which the adjusting element would be operated (refreshing or increasing the input energy).

The analysis and control unit 8 on its output side is connected by its output A1 to the temperature limiting protective device 7 for control of the cutoff temperature $T_A$ and it is connected also with the control stage 4 by its output A2, in order to be able to switch it off during a critical operating condition, namely the boil dry state. It is connected with a signaling and/or warning unit 9 by its output A3, in which the critical operating state is signaled by means of an optical or acoustic alarm signal.

Figure 6:
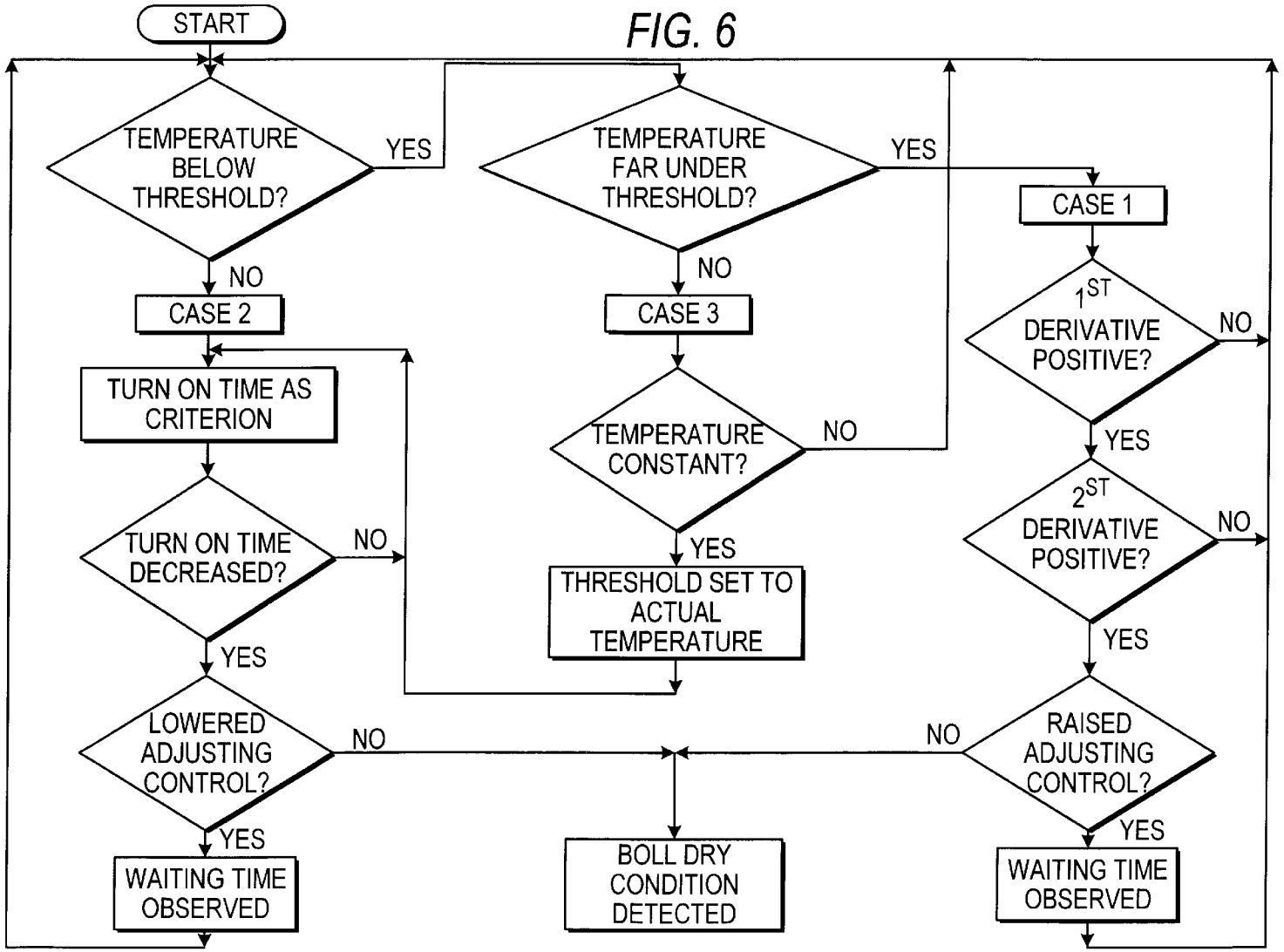
FIG. 6 is a flow chart of a program for the microprocessor in the apparatus of FIG. 6.

In this central analysis and control unit 8, which is formed preferably by a microprocessor, the already previously described method steps for detection of a boil dry state of a cooking utensil or vessel, which are placed on the cooking area 2, are performed. The coupling of the steps and the input signals is illustrated in FIG. 6 in the form of a standard flow chart of the individual program steps, from which the summary for the three described temperature pattern embodiments directly result. The individual steps of the flow chart according to FIG. 6 will not be repeated in detail here because of the above previous description of the individual method steps for the individual temperature pattern embodiments. The following additional remarks should be sufficient.

The temperature information $T_A$ is stored in the analysis and control unit 8, in order to calculate the adjusting rate from the five previous measured values and the extrapolation to the actual present time according to FIG. 4. If an approximately constant temperature in a range within 40 K of the threshold value for the temperature limiting protective device is established, this threshold value is reduced to the actual value in order to proceed according to the above-described case No. 3.

If the temperature of the cooking area is at the threshold value (case No. 2 above), the relative turn on time is stored for the last five values. If it drops in two successive periods about at least 2%, a boil dry condition is detected and e.g. the cooking area is turned off. In a typical cooking process when a boil dry condition occurs, the turn on duration drops within 6 minutes from an equilibrium value of 65% established during cooking with cooking materials to 35% during the boil dry condition, so that a drop of about twice 2% occurs very rapidly and can be reliably detected. If the adjusting device 5 is operated to change the power setting, the boil dry condition detection is put out of operation for 2 minutes necessarily, so that no erroneous shutoff occurs. Also the first and second derivatives of the temperature are determined in the analysis and control unit 8.

All that has been said in connection with the special features of the temperature measurement or input of energy to the heating element, especially the special features during clocked or pulsed input of energy, is true immediately for the apparatus or device shown in FIG. 5 and need not be repeated here at this point.

The electronic temperature limiting protective device is also shown as a separate stage 7 in FIG. 5. It can also in other embodiments be part of the analysis and control unit 8. In these other embodiments the shutoff temperature can be provided in the software.

In case the operator moves the cooking vessel or utensil slightly during the cooking, the cooking area is covered to a lesser extent and the temperature increases to and/or the turn-on temperature drops. The system according to the invention would characterize this as a boil dry condition and produce a signal. This is avoided by a preferred embodiment of the system when the form of the control signal or its further feeding or conducting is blocked for a predetermined time interval, preferably 2 minutes, when the vessel or utensil, detected by a standard utensil or pot detection circuit, covers only a predetermined percentage of the cooking area. It is not harmful to do this, since the user knows when the pan or pot is moved.

The disclosure in German Patent Application 199 06 115.7–34 of Feb. 13, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method and device for detection of a boil dry condition of a cooking utensil placed on a glass-ceramic cooking surface of a cooking unit, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A method for detecting a boil dry condition of a cooking utensil or vessel placed on a cooking zone of a glass-ceramic cooking surface of a cooking unit over an associated heating element for heating the cooking zone and the cooking utensil or vessel place thereof, said associated heating element having an energy input that is adjusted by means of a heating element power control device including means to measure the temperature in the cooking zone or a derivated quantity thereof (temperature signal) and including a temperature limiting protective device with an adjustable shutoff temperature for limiting the energy input and the temperature, said method of detecting said boil dry condition comprising the steps of a) measuring temperatures of said cooking zone to obtain respective measured temperature signal values at corresponding times;

b) comparing the respective measured temperature signal values with the shutoff temperature;

c) when the respective measured temperature signal values are outside of a predetermined temperature range at the shutoff temperature, calculating respective first and second differential quotients of said temperature signal values with respect to time and registering an operation of the power control device d) when said respective first and second differential quotients are positive and when said heating element power control device has not been operated within a predetermined time interval to increase the energy input to the heating element, generating a signal indicating that said boil dry condition has been detected.

2. A method for detecting a boil dry condition of a cooking utensil or vessel placed on a cooking zone of a glass-ceramic cooking surface of a cooking unit over an associated heating element for heating the cooking zone and the cooking utensil or vessel place thereof, said associated heating element having an energy input that is adjusted by means of a heating element power control device including means to measure the temperature in the cooking zone or a derivated quantity thereof (temperature signal) and including a temperature limiting protective device with an adjustable shutoff temperature for limiting the energy input and the temperature, said method of detecting said boil dry condition comprising the steps of a) measuring temperatures of said cooking zone to obtain respective measured temperature signal values at corresponding times;

b) comparing the respective measured temperature signal values with the shutoff temperature;

c) when the respective measured temperature signal values correspond to the shutoff temperature according to the comparing, determining the energy input to the heating element and registering an operation of the power control device d) when the energy input drops a predetemined amount and when said heating element power control device has not been operated within a predetermined time interval to increase the energy input to the heating element, generating a signal indicating that said boil dry condition has been detected.

3. The method as defined in claim 2, further comprising halting the generating of the control signal for a predetermined time span when said heating element power control device is operated to reduce said energy input and after said halting testing whether or not said measured temperature is equal to or is less than said shutoff temperature so that said boil dry condition may be detected by testing a first derivative of said measured temperature and a second derivative of said measured temperature.

4. The method as defined in claim 3, wherein said predetermined time span is two minutes.

5. A method for detecting a boil dry condition of a cooking utensil or vessel placed on a cooking zone of a glass-ceramic cooking surface of a cooking unit over an associated heating element for heating the cooking zone and the cooking utensil or vessel place thereof, said associated heating element having an energy input that is adjusted by means of a heating element power control device including means to measure the temperature in the cooking zone or a derivated quantity thereof (temperature signal) and including a temperature limiting protective device with an adjustable shutoff temperature for limiting the energy input and the temperature, said method of detecting said boil dry condition comprising the steps of a) measuring temperatures of said cooking zone to obtain respective measured temperature signal values at corresponding times;

b) comparing the respective measured temperature signal values with the shutoff temperature;

c) when the respective measured temperature signal values are outside of a predetermined temperature range at the shutoff temperature, lowering the shutoff temperature to the measured temperature, when a temperature equilibrium exists within a predetermined temperature range at said shutoff temperature during the comparing and registering an operation of the power control device d) when the energy input drops a predetermined amount and when said heating element power control device has not been operated within a predetermined time interval to increase the energy input to the heating element, generating a signal indicating that said boil dry condition has been detected.

6. The method as defined in claims 5, further comprising restoring said shutoff temperature to an original value thereof when said heating element power control device is again operated.

7. The method as defined in claim 1 or 5, wherein said predetermined temperature range around said measured temperature in relation to said shutoff temperature is 40 K.

8. The method as defined in claim 2 or 5, further comprising lowering the energy input by a predetermined minimum amount of about 2% per minute after the determining of the energy input prior to the generating of the control signal.

9. The method as defined in claim 1, 2 or 5, further comprising supplying said energy input to said heating element periodically by means of a clock signal and wherein said temperature signal is used to determine said measured temperature and is clocked and synchronized to said clock signal.

10. The method as defined in claim 1, wherein said first time derivative of said measured temperature is formed from a temperature adjusting rate through previously determined measured temperature values and from respective differences between corresponding measured temperature values and extrapolated measured temperature values derived from said temperature adjusting rate.

11. The method as defined in claim 1, wherein said second time derivative of said measured temperature is formed from a first time derivative adjusting rate through previous values of said first time derivative and respective differences between corresponding actual values of said first time derivative and extrapolated second time derivative values derived from said first time derivative adjusting rate.

12. The method as defined in claim 1, wherein said first time derivative and said second time derivative are both derived from measured values of a temperature-dependent variable.

13. The method as defined in claim 1, 2, or 5, wherein said control signal is a shutoff signal for said heating element and an alarm signal and said alarm signal is an acoustic or optical signal.

14. The method as defined in claim 1, 2, or 5, wherein said control signal comprises an alarm signal for activation of a remote alarm by means of a home bus.

15. The method as defined in claim 1, 2 or 5, further comprising suppressing the generating of the control signal, or suppressing further processing of the control signal, for a predetermined time interval when said cooking utensil or vessel covers only a predetermined percentage of said at least one cooking zone.

16. A device for detecting a boil dry condition of a cooking utensil or vessel placed on a glass-ceramic cooking surface (1) of a cooking unit having at least one cooking zone (2) that is associated with a heating element (3), whose energy input is adjusted by means of a heating element power control device (4, 5), and in which a temperature, or a variable derived from said temperature, or a temperature signal depending on said temperature, is measured during operation and limited by means of a temperature limiting protective device (7) with an adjustable shutoff temperature, said device comprising a central analysis and control unit (8), means (6) for generating said temperature signal, means for generating a signal indicating operation of said heating element power control device, means for generating a signal according to said energy input to said heating element, means for generating a signal corresponding to said shutoff temperature and means for inputting said signals to said central analysis and control unit (8);

wherein said central analysis and control unit (8) includes means for generating a shutoff control signal for control and adjustment of said shutoff temperature of said temperature limiting protective device (7), means for generating a signal for control of said heating element power control device, means for comparing a measured cooking zone temperature with said shutoff temperature, said temperature signal being indicative of said cooking zone temperature, and means for generating a control signal for detection of said boil dry condition according to said comparing;

wherein said means for generating said control signal comprises means for forming a first time derivative of said temperature signal, means for forming a second time derivative of said temperature signal and means for detecting said signal indicating operation of said heating element power control device when said temperature signal indicates said cooking zone temperature is outside of a predetermined temperature range at the shutoff temperature and means for outputting said control signal when both said first time derivative and said second time derivative are positive and the heating element power control device has not been operated within a predetermined time interval to increase input power to the heating element; or wherein said means for generating said control signal comprises means for determining the energy input to the heating element from the signal according to the energy input and for detecting operation of the heating element power control device from said signal indicative of said operation when said cooking zone temperature corresponds to the shutoff temperature and means for outputting said control signal when the energy input is reduced a predetermined amount and the heating element power control device has not been operated within a predetermined time interval to reduce energy input to the heating element; or wherein said means for generating said control signal comprises means for lowering the shutoff temperature to said cooking zone temperature, said temperature signal being indicative of said cooking zone temperature, when a temperature equilibrium exists within a predetermined range at said shutoff temperature during the comparing, means for determining the energy input to the heating element from the signal indicative of the energy input and for detecting operation of the heating element power control device from the signal indicative of operation thereof and means for outputting said control signal when the energy input is reduced a predetermined amount and the heating element power control device was not operated to reduce energy input to the heating element within a predetermined time interval.

17. The device as defined in claim 16, wherein said central analysis and control unit (8) comprises a signaling warning device (9) for generating a warning signal warning of said boil dry condition.

18. The device as defined in claim 16, wherein said control signal is a shutoff signal for said heating element (3) and a warning signal for said boil dry condition and further comprising a signaling a warning means (9) for generating an optical or acoustic signal for an operator in response to said warning signal from said means for generating said control signal.

19. The device as defined in claim 16, further comprising means for detecting a position of a cooking utensil or vessel on said at least one cooking zone and wherein said means for generating said control signal is coupled with said means for detecting said position of said cooking utensil or vessel, whereby said means for generating said control signal is suppressed or turned off for a predetermined time span, or further processing of said control signal is suppressed, when said cooking utensil or vessel is moved a predetermined amount on said at least one cooking zone.

* * * * *